US010557108B2

(12) United States Patent
Borup et al.

(10) Patent No.: US 10,557,108 B2
(45) Date of Patent: Feb. 11, 2020

(54) TRIGGERED RELEASE SYSTEM

(75) Inventors: Flemming Borup, Tygelsjoe (SE); Thomas Hoenger Callisen, Frederiksberg C (DK); Kirk Matthew Schnorr, Holte (DK); Ole Simonsen, Soeborg (DK); Christian Wieth, Virum (DK); Judith Maria Bonsall, Bebington (GB); Andrew Paul Chapple, Bebington (GB); Anthony Hackett, Bebington (GB); Christopher Clarkson Jones, Bebington (GB); David Richard Arthur Mealing, Bebington (GB); Rajesh Amrit Salkar, Bebington (GB)

(73) Assignee: NOVOZYMES A/S, Bagsvaerd (DK)

( * ) Notice: Subject to any disclaimer, the term of this patent is extended or adjusted under 35 U.S.C. 154(b) by 793 days.

(21) Appl. No.: 12/934,877

(22) PCT Filed: Mar. 25, 2009

(86) PCT No.: PCT/EP2009/053487

§ 371 (c)(1),
(2), (4) Date: Sep. 27, 2010

(87) PCT Pub. No.: WO2009/118329

PCT Pub. Date: Oct. 1, 2009

(65) Prior Publication Data

US 2011/0028372 A1 Feb. 3, 2011

(30) Foreign Application Priority Data

Mar. 28, 2008 (EP) ..... 08153550

(51) Int. Cl.
*C11D 17/00* (2006.01)
*C11D 3/386* (2006.01)

(52) U.S. Cl.
CPC ..... *C11D 17/0039* (2013.01); *C11D 3/38672* (2013.01)

(58) Field of Classification Search
CPC ..... C11D 17/0039; C11D 3/38672; C11D 3/38627; C11D 3/386
USPC ..... 510/220, 246, 392, 441, 443
See application file for complete search history.

(56) References Cited

U.S. PATENT DOCUMENTS

| | | | | |
|---|---|---|---|---|
| 5,733,763 | A | 3/1998 | Markussen | |
| 5,846,798 | A | 12/1998 | Paatz et al. | |
| 6,462,007 | B1 * | 10/2002 | Pieroni et al. | 510/224 |
| 2003/0191043 | A1 | 10/2003 | Becker et al. | |
| 2004/0106534 | A1 * | 6/2004 | Nitsch et al. | 510/220 |
| 2004/0254087 | A1 * | 12/2004 | Simonsen | 510/446 |
| 2005/0003980 | A1 | 1/2005 | Baker et al. | |
| 2005/0020476 | A1 * | 1/2005 | Wahl | C11D 3/001 510/515 |

FOREIGN PATENT DOCUMENTS

| | | |
|---|---|---|
| EP | 0304332 | 2/1989 |
| EP | 0458845 | 12/1991 |
| EP | 0971024 | 1/2000 |
| EP | 1388585 | 2/2004 |
| EP | 1479755 A1 | 11/2004 |
| WO | WO 97/22680 | 6/1997 |
| WO | WO 99/29820 | 6/1999 |
| WO | WO 99/37746 | 7/1999 |
| WO | WO 01/44434 | 6/2001 |

OTHER PUBLICATIONS

Search report issued in corresponding International Application No. PCT/EP2009/53487 dated Jul. 6, 2009.
Artikel, Chitin, Rompp Chemie Lexikon, vol. 9, Auflage, pp. 689-690 (1995).

* cited by examiner

*Primary Examiner* — Ling Siu Choi
*Assistant Examiner* — Ronald Grinsted
(74) *Attorney, Agent, or Firm* — Eric Fechter

(57) ABSTRACT

The combination of an enzyme substrate and an enzyme capable of accelerating the modification of said substrate, provides a triggered release system which works especially well. The use of the enzyme-triggered release system can retain a rinse benefit agent during the wash stage and release it during the subsequent rinse stage.

21 Claims, No Drawings

TRIGGERED RELEASE SYSTEM

CROSS-REFERENCE TO RELATED APPLICATIONS

This application is a 35 U.S.C. 371 national application of PCT/EP2009/053487 filed Mar. 25, 2009, which claims priority or the benefit under 35 U.S.C. 119 of European application no. 08153550.2 filed Mar. 28, 2008, the contents of which are fully incorporated herein by reference.

FIELD OF THE INVENTION

The present invention relates to detergent particles comprising a triggered release system for a rinse benefit agent. The invention further relates to the manufacture of said particles and the use of them. In a further aspect, the invention relates to a dishwash detergent composition comprising said particles and to its use in dishwashing.

BACKGROUND OF THE INVENTION

It is known to the art to prepare particles comprising different kinds of release systems in order to release active compounds or benefit agents at the right point in time to obtain the best possible use of the active components.

For many years it was common practice to make laundry, dishwashing or cleaning products available to consumers in the form of bulk-packaged products and to leave it to the consumer's discretion when using the product, to apportion the laundry, dishwashing or cleaning product to suit requirements specific to the application which were governed by the hardness of the water, the nature, amount and/or degree of soiling of the clothes, dishes etc. to be washed or articles to be cleaned, the amount of liquid in the laundry, dishwashing or cleaning bath, or other parameters.

In view of consumers' desire to obtain laundry, dishwashing or cleaning products that could be apportioned more easily and conveniently, these products have increasingly been made available in a form rendering individual apportionment superfluous: laundry, dishwashing or cleaning products have been made up in measured portions containing all the constituents needed for a laundry, dishwashing or cleaning cycle. In the case of solid products, such portions have frequently been formed into shapes (sometimes containing more than one phase), such as pellets, beads, tablets ("tabs"), blocks, briquettes, etc., which are introduced into the wash liquor as intact products. It has also been proposed to enclose liquid products in water-soluble capsules that dissolve upon contact with the aqueous bath and release their contents into the bath.

One drawback for some of these products is that all the constituents needed in the course of a laundry, dishwashing or cleaning cycle enter the water bath at the same time. Not only does this create problems of incompatibility of certain constituents of a laundry, dishwashing or cleaning product with other constituents, but also it becomes impossible to selectively introduce specific constituents into the bath at a defined point in time. Another drawback is that even if a delayed release mechanism is incorporated in the solutions then it is not very effective and it is difficult to provide a desired release profile.

In the state of the art, means have more recently been described whereby individual laundry, dishwashing or cleaning product constituents can be selectively apportioned at a defined point in time during their application. For example, temperature-controlled release of active ingredients has been described, allowing active substances like surface-active agents, bleaching agents, soil release polymers and the like to be released in the main wash, or cleaning cycle, or even in a post treatment cycle, e.g. in the final rinse in the case of machine dishwashing.

The use of paraffin waxes with a melting point above 50° C. has been described on a number of occasions. One product on the market uses a paraffin wax core as a carrier or matrix in a dishwashing tablet, in order that a final-rinse surface-active agent ("rinse aid") incorporated therein does not get released during the cleaning cycle and is not released until the final rinse cycle of a dishwashing machine. If released too soon, for example during the cleaning cycle, the final-rinse surface-active agent will for the most part be pumped away in the intermediate rinse and will then yield little or no effect in the final rinse. Adoption of a matrix material with a melting point at the temperature of the final rinse cycle ensures that the final-rinse surface-active agent emulsified in the matrix (or, ideally, in molecular dispersion in the matrix) stays enclosed in the matrix during the cleaning cycle, which is run at temperatures of up to 55° C., and is not released until the matrix material melts in the final rinse cycle in which temperatures of up to about 65° C. are attained.

This solution for protecting the final-rinse surface-active agent has proved effective in practice. One drawback, however, is that the amount of matrix material in a dishwashing tablet core consisting of paraffin wax and final-rinse surface-active agent accounts for between 30 and 95% of the total mass of the core, typically approx. 50% of the total mass. The matrix material, especially in this quantity, may leave residues on the cleaned articles, e.g. on crockery or glassware, and moreover may interfere with the action of the final-rinse surface-active agent which it contains and which is released when the paraffin wax melts. One reason for this could be that the final-rinse surface-active agent remains bonded to the boundary surface between the lipophilic carrier material and the rinse bath after the paraffin wax has melted, and therefore fails to yield the desired effect.

Another drawback of temperature-controlled release of active ingredients in laundry or dishwashing products is that typical domestic laundry and dishwashing machines have quite a large number of programs that differ significantly, particularly in their temperature and time profiles. For example, the programs most commonly adopted in modern dishwashing machines have peak temperatures in the cleaning cycle of 50 to 60° C. or 60 to 70° C.; the precise temperature level can vary depending on the manufacturer and the type of machine.

WO 01/44434 (Henkel) relates to combinations of physico-chemical triggers with enzyme triggers which results in perforation of particles due to enzyme activity in the wash solution. However, certain drawbacks are seen in having the enzymes in the wash water; this technology necessitate that the detergent comprises the required enzymes to perforate the particle. The detergent needs to be formulated in a way which is non-hostile to the enzymes. Moreover, it is difficult to ensure the right enzyme activity in the detergent to guarantee release of the payload at the right time in the wash process.

WO 9937746 (Procter & Gamble) relates to a multi-layer detergent tablet comprising a core, a first encapsulating layer comprising a detergent active, and a second encapsulating layer comprising a disruption system, which leads to delayed release of the detergent active.

EP-A-971 024 (Procter & Gamble) discloses laundry cleaning compositions comprising a detersive ingredient and a product of the reaction between a primary amine and a perfume component. It is described that the active component is released over a longer period than when it is used on its own.

The following documents disclose other examples of particles for use in detergents: US 2003/0191043, US 2005/003980, WO 99/29820, WO 97/22680, EP 1 388 585, EP 304332, EP 458845, U.S. Pat. No. 5,733,763.

SUMMARY OF THE INVENTION

There is a continuous need for alternative or improved feasible triggered release technologies for laundry and dishwash applications. Due to price and technical challenges, detergent producers are limited in their choices of use of, e.g. perfume and fabric care ingredients. The present invention provides an ability to formulate in a cost-efficient manner more effective release systems targeted for the rinse phase of a laundry or dishwash process.

We have in our search for improved release systems for detergent particles surprisingly found that the combination of an enzyme substrate and an enzyme capable of accelerating the modification of said substrate, provides a triggered release system which works especially well. We have found that the use of the enzyme-triggered release system can retain a rinse benefit agent during the wash stage and release it during the subsequent rinse stage. The enzyme is triggered by the lower surfactant concentration during rinsing and it will start to react with the substrate whereby the particle will become unstable, degrade and/or fall apart whereby the rinse benefit agent is released to the rinse liquor. The surfactant concentration typically drops from a level above the critical micelle concentration (CMC) of the surfactant to a level below the CMC.

One objective of the present invention is to provide a system to release rinse benefit agents into a rinse liquor in a dish wash or laundry process, at a desired process stage or point in time in the application. In use, such a triggered release system does not require that the liquid composition is especially tailored to the release system.

We have surprisingly found that a particle comprising a rinse benefit agent and an enzyme surrounded by a barrier layer comprising a substrate for said enzyme provides a system that is optimal for release of rinse benefit agents such as perfume to a laundry or dishwash process.

The particle of the present invention comprises an enzyme triggered release system comprising a rinse benefit agent and an enzyme-substrate pair enabling the triggered release of the rinse benefit agent at the rinse stage in a laundry or dishwashing process. The enzyme-substrate pair used in the present invention forms part of an effective triggered release system for the delivery of a rinse benefit agent in order to obtain the right release profile during the application.

Hence the detergent particles of the present invention comprise:

a) a rinse benefit agent, b) an enzyme, and c) a substrate for said enzyme, wherein the rinse benefit agent and the enzyme are enclosed in (surrounded by) a barrier layer comprising the substrate.

The present invention further relates to a method for preparing the particles, to a dishwash detergent composition comprising the particles and to the use of said particles. Finally, the invention provides a process for washing kitchenware, comprising a washing step wherein soiled kitchenware is contacted with an aqueous composition comprising the dishwash detergent composition of claim 12, followed by a rinsing step wherein the rinse benefit agent is released from the particles into the rinse liquid.

DETAILED DESCRIPTION OF THE INVENTION

All percentages and ratios are calculated by weight unless otherwise indicated. All percentages are calculated based on the total composition unless otherwise indicated. A substance is considered insoluble if it has a solubility below 1 g/l in water at 25° C., particularly below 0.5 g/l, below 0.2 g/l or below 0.1 g/l.

The inventors herein do not intend to be limited by materials under a certain trade name. Equivalent materials (e.g., those obtained from a different source under a different name or catalogue (reference) number) to those referenced by trade name may be substituted and utilized in the compositions herein.

All documents referred to herein, including all patents, patent applications, and printed publications, are hereby incorporated by reference in their entirety.

The Particle

In a particular embodiment, the particle of the invention comprises a core containing the rinse benefit agent and a layer surrounding the core. The core may comprise an inert carrier particle, consisting, e.g., of $Na_2SO_4$, carbonate or silicate. The rinse benefit agent, the substrate and the enzyme may be present together in the core and/or in the same layer.

The particle comprises a barrier layer. The benefit agent, the enzyme and the substrate may be present homogenously mixed together in a matrix which is either the core of the particle or a layer.

The particle may comprise a first layer and a second layer. The first layer may comprise the enzyme and the second layer may comprise the substrate to the enzyme that is present in the first layer.

In a particular embodiment the enzyme and the substrate are present in the particle in such a way that they are in physical contact, thus either in the same layer or matrix or in layers bordering each other. There may be a thin water soluble layer between the layer comprising the enzyme and the layer comprising the substrate.

In a particular embodiment of the present invention the particle comprises:

a) a core comprising a rinse benefit agent, b) optionally a protective layer, c) a layer comprising an enzyme, and d) a barrier layer comprising a substrate for the enzyme in c).

The particle may further comprise one or more additional coatings.

The particles of the present invention are preferably between 0.001 mg to 10000 mg. In a more particular embodiment of the present invention, the particles weigh between 0.005 mg to 1000 mg. In an even more particular embodiment the mean particle weight is between 0.01 mg to 100 mg.

The mean particle size is in a particular embodiment in the range of 0.1 to 2000 μm. In a more particular embodiment the mean particle size is in the range of 50 to 1400 μm. In a most preferred embodiment of the present invention, the mean particle size is in the range of 100 to 1000 μm. In a further embodiment the mean particle size of the present invention is in the range of 100 to 800 μm.

For use in dishwashing, the particles should be chosen sufficiently large that they are not discharged to a significant extent during the pumping out after the main cleaning cycle. Thus, the mean particle size may be greater than 1 mm or greater than 3 mm, e.g. in the range 3-20 mm or 5-15 mm. In a particular embodiment of the present invention the particles of the invention release more than 60% of the rinse benefit agent in the rinse phase of a washing process. In a more particular embodiment the particles of the invention releases more than 70% of the rinse benefit agent in the rinse phase. The release of rinse benefit agent can be measured by means of the method described in Example 6.

Core

The detergent particle may comprise a core surrounded by one or more layers. The core of the particle may comprise the rinse benefit agent either alone or in combination with other constituents.

The core may comprise a preformed core such as an inert core upon which the rinse benefit agent is deposited or a core prepared of porous material into which the rinse benefit agent is deposited. In a preferred embodiment the rinse benefit agent is deposited into the core.

The benefit agent may be incorporated into the core at the same time as the core particle is prepared. In a preferred embodiment, the core is prepared by the granulation of filler components in the presence of the rinse benefit agent and, optionally, an additional binder material.

Preformed cores may also be called carrier particles; nuclei, placebo nuclei (nucleus free of active compound) or seeds are inert particles upon which the mixture comprising the active compound can be deposited. The preformed cores may comprise inorganic salts, starch, sugars, sugar alcohols, small organic molecules such as organic acids or salts, such as carbonate, minerals such as clays, zeolite or silicates or a combination of two or more of these.

In a particular embodiment of the present invention the core may be prepared by applying the mixture comprising the rinse benefit agent onto a preformed core.

Barrier Layer

The particle of the present invention comprises a barrier layer. Said barrier layer provides either a physical barrier and/or a transport barrier (including charge) to the rinse benefit agent in question. Thus the barrier layer, prevents, reduces, delays and/or inhibits the passage of the rinse benefit agent from the particle.

The barrier layer may prevent leakage or undesired migration or transport of the rinse benefit agent from the particle into the wash liquor during the wash stage. The barrier layer may also improve the particle stability beneficial in formulation, storage and application.

The barrier layer may act as a scaffold for the substrate. The substrate may itself act as a barrier layer or it may be a secondary component which by virtue of the enzymatic activity affects properties of the barrier material.

The barrier layer comprises the substrate and may comprise the enzyme. In a particular embodiment of the present invention the substrate present in the barrier layer is present in an amount of said layer so the enzyme accelerates the alteration of the substrate to such an extent that the barrier layer loses its integrity whereby the rinse benefit agent is released into the wash liquor. The barrier layer may comprise 1-100% w/w of substrate. Thus, the amount of substrate may be at least 10% w/w of the barrier layer, particularly at least 20%, at least 30%, at least 40%, at least 50%, at least 60%, at least 70% or at least 80% w/w of the barrier layer. The amount of substrate in the barrier layer may particularly be from 30-100% w/w of the barrier layer, e.g. from 40-90% w/w, 50-80% w/w, less than 90% w/w, less than 80%, or less than 70%.

The barrier layer should contain a water-insoluble continuous layer which is preferably hydrophobic and may comprise suspended particles. The main component of the continuous layer may be the enzyme substrate, or it may be inert. Thus, the main component can be a triglyceride such as a fat or oil, paraffin, tripalmitin, palm oil, beeswax, jojoba wax, polyesters, ester wax, polycaprolactone (PCL), polymers such as polystyrene and polybutyleneoxide, and mixtures thereof or a polymer such as polystyrene or polycarbonate. The suspended particles (if present) may comprise the enzyme or the substrate, or it may be inert, e.g., a filler, kaolin, talc, clay, silica, dye particles or calcium carbonate.

Conventional coatings and methods as known to the art may suitably be used, such as the coatings described in WO 89/08694, WO 89/08695, 270 608 B1 and/or WO 00/01793. Other examples of conventional coating materials may be found in U.S. Pat. No. 4,106,991, EP 170360, EP 304332, EP 304331, EP 458849, EP 458845, WO 97/39116, WO 92/12645A, WO 89/08695, WO 89/08694, WO 87/07292, WO 91/06638, WO 92/13030, WO 93/07260, WO 93/07263, WO 96/38527, WO 96/16151, WO 97/23606, U.S. Pat. Nos. 5,324,649, 4,689,297, EP 206417, EP 193829, DE 434-4215, DE 4322229 A, DD 263790, JP 61162185 A and/or JP 58179492.

It is of significance that the detergent particle does not dissolve or fall apart before the rinse benefit agent is to be released to the washing process during rinse. To preserve structural integrity of the particle, the barrier layer may comprise a material which does not melt or disintegrate such that it significantly compromises the properties of the barrier layer, when exposed to temperatures above 35° C. or are not particularly soluble in wash liquor or other aqueous solvents. In another embodiment the enzyme substrate does not have a melting point in the range of 35° C. to 50° C.

Rinse Benefit Agent

The rinse benefit agent is a compound, which performs its function during a rinsing cycle of a laundry or dishwash machine, either by improving the result of the washing process or by delivering a benefit as perceived by the user. In particular, the rinse benefit agent includes perfumes, encapsulated perfumes, fragrances, pro-fragrances, chemical malodour neutralizers, physical malodour neutralizers, fibre lubricants, anti-static agents, anti-wrinkle agents, anti-foams, photo-protective agents, optical brighteners, soil release polymers, soil repelling agents, stain repellent agents, fabric softening compounds, anti-microbial agents, insecticides, fungicides, insect repellents, antioxidants, moisture management agents, shading dyes and pigments, dye fixing agents, fabric care agents, silicone oils, a second enzyme and mixtures thereof. For use in a dishwash detergent composition, the particles of the invention may comprise rinse benefit agents such as clear rinsing agents, antibacterial compositions, silver protection agents, fragrances, disinfectants, odor masking agents and a second enzyme.

Fragrances which may be employed in fragrance particles according to the present invention are those which can be usefully released at sufficient dosage over a required period of time from the fragrance particle. They may be selected for example from natural, essential oils or synthetic perfumes, and blends thereof. Many fragrances are polar in nature because they contain substantial amounts of alcohols and other polar compounds. Typical perfumery materials include natural oils such as lemon oil, mandarin oil, clove leaf oil, cedar wood oil, rose absolute or jasmine absolute, natural resins such as labdanum resin or olibanum resin; single perfumery chemicals which may be isolated from natural sources or manufactured synthetically, as for example alcohols such as geranoil, nerol, citronellol, linalool, tetrahydrogeranoil, betaphenylathyl alcohol, methyl phenyl carbinol, dimethyl benzyl carbonol, menthol or cedrol; acetates and other esters derived from such alcohols; aldehydes such as citral, citronellal, hydroxycitronella, lauric aldehyde, undecylenic aldehyde, cinnamaldehyde, amyl cinnamic aldehyde, vanillin or heliotropin; acetals derived from such aldehydes; ketones such as methyl hexyl ketone, the ionones and the methylionones; phenolic compounds such as eugenol and isoeugenol; synthetic musks such as musk xylene, musk ketone and ethylene brassylate; and the like.

Perfume or fragrances may be added to laundry, dishwash or cleaning compositions in order to enhance overall esthetic appeal of the products and to provide the consumer with not only the performance (fabric softening, clear rinsing) but also a sensorially unmistakable product. With perfume oils or fragrances it is possible to use individual odorant compounds, examples being the synthetic products of the ester, ether, aldehyde, ketone, alcohol, and hydrocarbon types. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate, and benzyl salicylate. The ethers include, for example, benzyl ethyl ether. The aldehydes include, for example, the linear alkanals having 8 to 18 carbon atoms, citral, citronellal, citronellyloxyacetaldehyde, cyclamen aldehyde, hydroxycitronellal, lilial and bourgeonal. The ketones include, for example, the ionones, α-isomethylionone and methyl cedryl ketone. The alcohols include anethole, citronellol, eugenol, geraniol, linalool, phenylethyl alcohol, and terpineol. The hydrocarbons include primarily terpenes such as limonene and pinene.

Preference is given to the use of mixtures of different odorants, which are blended so that together they produce an appealing fragrance. Such perfume oils may also contain natural odorant mixtures, as obtainable from plant sources. Examples are pine oil, citrus oil, jasmine oil, patchouli oil, rose oil or ylang-ylang oil. Likewise suitable are nutmeg oil, sage oil, chamomile oil, clove oil, balm oil, mint oil, cinnamon leaf oil, lime blossom oil, juniper berry oil, vetiver oil, olibanum oil, galbanum oil and labdanum oil, orange blossom oil, neroli oil, orange peel oil, and sandalwood oil.

In a particular embodiment the fragrance content is in the region of up to 2% by weight of the overall detergent composition. The perfume is typically present in an amount of from 10-85% by total weight of the particle, preferably from 20 to 75% by total weight of the particle.

The perfume suitably has a molecular weight of from 50 to 500.

Top notes are defined by Poucher (Journal of the Society of Cosmetic Chemists 6(2):80 [1955]). Examples of well known top-notes include citrus oils, linalool, linalyl acetate, lavender, dihydromyrcenol, rose oxide and cis-3-hexanol.

Typical perfume components which it is advantageous to encapsulate, include those with a relatively low boiling point, preferably those with a boiling point of less than 300, preferably 100-250 Celsius.

It is also advantageous to encapsulate perfume components which have a low Log P (ie. those which will be partitioned into water), preferably with a Log P of less than 3.0. These materials, of relatively low boiling point and relatively low Log P have been called the "delayed blooming" perfume ingredients and include the following materials:

Allyl Caproate, Amyl Acetate, Amyl Propionate, Anisic Aldehyde, Anisole, Benzaldehyde, Benzyl Acetate, Benzyl Acetone, Benzyl Alcohol, Benzyl Formate, Benzyl Iso Valerate, Benzyl Propionate, Beta Gamma Hexenol, Camphor Gum, Laevo-Carvone, d-Carvone, Cinnamic Alcohol, Cinamyl Formate, Cis-Jasmone, cis-3-Hexenyl Acetate, Cuminic Alcohol, Cyclal C, Dimethyl Benzyl Carbinol, Dimethyl Benzyl Carbinol Acetate, Ethyl Acetate, Ethyl Aceto Acetate, Ethyl Amyl Ketone, Ethyl Benzoate, Ethyl Butyrate, Ethyl Hexyl Ketone, Ethyl Phenyl Acetate, Eucalyptol, Eugenol, Fenchyl Acetate, Flor Acetate (tricyclo Decenyl Acetate), Frutene (tricyclco Decenyl Propionate), Geraniol, Hexenol, Hexenyl Acetate, Hexyl Acetate, Hexyl Formate, Hydratropic Alcohol, Hydroxycitronellal, Indone, Isoamyl Alcohol, Iso Menthone, Isopulegyl Acetate, Isoquinolone, Ligustral, Linalool, Linalool Oxide, Linalyl Formate, Menthone, Menthyl Acetphenone, Methyl Amyl Ketone, Methyl Anthranilate, Methyl Benzoate, Methyl Benzyl Acetate, Methyl Eugenol, Methyl Heptenone, Methyl Heptine Carbonate, Methyl Heptyl Ketone, Methyl Hexyl Ketone, Methyl Phenyl Carbinyl Acetate, Methyl Salicylate, Methyl-N-Methyl Anthranilate, Nerol, Octalactone, Octyl Alcohol, p-Cresol, p-Cresol Methyl Ether, p-Methoxy Acetophenone, p-Methyl Acetophenone, Phenoxy Ethanol, Phenyl Acetaldehyde, Phenyl Ethyl Acetate, Phenyl Ethyl Alcohol, Phenyl Ethyl Dimethyl Carbinol, Prenyl Acetate, Propyl Bornate, Pulegone, Rose Oxide, Safrole, 4-Terpinenol, Alpha-Terpinenol, and/or Viridine Part or all of the perfume may be in the form of a pro-fragrance. For the purposes of the present invention a pro-fragrance is any material which comprises a fragrance precursor that can be converted into a fragrance.

Suitable pro-fragrances are those that generate perfume components which are aldehydes. Aldehydes useful in perfumery include but are not limited to phenylacetaldehyde, p-methyl phenylacetaldehyde, p-isopropyl phenylacetaldehyde, methylnonyl acetaldehyde, phenylpropanal, 3-(4-t-butylphenyl)-2-methyl propanal, 3-(4-t-butylphenyl)-propanal, 3-(4-methoxyphenyl)-2-methylpropanal, 3-(4-isopropylphenyl)-2-methylpropanal, 3-(3,4-methylenedioxyphenyl)-2-methyl propanal, 3-(4-ethylphenyl)-2,2-dimethylpropanal, phenylbutanal, 3-methyl-5-phenylpentanal, hexanal, trans-2-hexenal, cis-hex-3-enal, heptanal, cis-4-heptenal, 2-ethyl-2-heptenal, 2,6-dimethyl-5-heptenal, 2,4-heptadienal, octanal, 2-octenal, 3,7-dimethyloctanal, 3,7-dimethyl-2,6-octadien-1-al, 3,7-dimethyl-1,6-octadien-3-al, 3,7-dimethyl-6-octenal, 3,7-dimethyl-7-hydroxyoctan-1-al, nonanal, 6-nonenal, 2,4-nonadienal, 2,6-nonadienal, decanal, 2-methyl decanal, 4-decenal, 9-decenal, 2,4-decadienal, undecanal, 2-methyldecanal, 2-methylundecanal, 2,6,10-trimethyl-9-undecenal, undec-10-enyl aldehyde, undec-8-enanal, dodecanal, tridecanal, tetradecanal, anisaldehyde, bourgenonal, cinnamic aldehyde, a-amylcinnam-aldehyde, a-hexyl cinnamaldehyde, methoxy-cinnamaldehyde, citronellal, hydroxy-citronellal, isocyclocitral, citronellyl oxyacet-aldehyde, cortexaldehyde, cumminic aldehyde, cyclamen aldehyde, florhydral, heliotropin, hydrotropic aldehyde, lilial, vanillin, ethyl vanillin, benzaldehyde, p-methyl benzaldehyde, 3,4-dimethoxybenzaldehyde, 3- and 4-(4-hydroxy-4-methyl-pentyl)-3-cyclohexene-1-carboxaldehyde, 2,4-dimethyl-3-cyclohexene-1-carboxaldehyde, 1-methyl-3-(4-methylpentyl)-3-cyclohexen-carboxaldehyde, p-methylphenoxyacetaldehyde, and mixtures thereof.

Suitable fabric softening and/or conditioning agent groups are preferably chosen from those of the cationic detergent active type, clays and silicones. Those of the cationic detergent active type are preferably selected from quaternary ammonium cationic molecules, for example those having a solubility in water at pH 2.5 and 20° C. of less than 10 g/l.

Fabric softening compounds which may be contained in particles according to the present invention may be cationic, e.g. substantially water-insoluble quaternary ammonium materials comprising a single alkyl or alkenyl long chains having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl of alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening are predominantly linear. Silicones with similar functional properties may also be preferred.

It is preferred for the ester-linked quaternary ammonium compounds to contain two or more ester groups. In both monoester and the diester quaternary ammonium compounds it is preferred if the ester group (s) is a linking group between the nitrogen atom and an alkyl group. The ester groups (s) are preferably attached to the nitrogen atom via another hydrocarbyl group.

If the fabric softening and/or conditioning group (s) is/are silicones, then suitable materials include: non-volatile silicone fluids, such as poly (di) alkyl siloxanes, especially polydimethyl siloxanes and carboxylated or ethoxylated variants. They may be branched, partially cross-linked or preferably linear aminosilicones, comprising any organosilicone having amine functionality.

Suitable silicones include dimethyl, methyl (aminoethylaminoisobutyl) siloxane, typically having a dynamic viscosity of from 100 mPas to 200 000 mPas (when measured at 25° C. and a shear rate of around 100 s) with an average amine content of ca. 2 mol %.

The second enzyme could be used for the purpose of bacterial control (e.g., a protease or lysozyme), as a fabric care active (e.g. a cellulase), as an activator (e.g. a lipase degrading pro-perfumes or pro-bleach molecules), for prevention of biofilm or for prevention of odor in washing machines washing always at low temperatures.

The amount of rinse benefit agent present in the particle may be from 1 to 95%, preferably 10 to 95% more preferably 30 to 90%.

The Enzyme Acting on the Substrate

The enzyme may either hydrolyze the enzyme substrate or help in the process of modifying its properties in such a way as to destroy its barrier properties and thereby destabilize the particles' structural integrity. The enzyme in the context of the present invention may be any enzyme or combination of different enzymes. Accordingly, when references are made to "an enzyme" this will in generally be understood not only single enzymes but to combinations of more than one enzyme.

The particles of the present invention may comprise at least one, at least two or at least three enzymes.

It is to be understood that enzyme variants (produced, for example, by recombinant techniques) are included within the meaning of the term "enzyme". Examples of such enzyme variants are disclosed, e.g. in EP 251,446 (Genencor), WO 91/00345 (Novo Nordisk), EP 525,610 (Solvay) and WO 94/02618 (Gist-Brocades NV).

The enzyme classification employed in the present specification with claims is in accordance with *Recommendations* (1992) *of the Nomenclature Committee of the International Union of Biochemistry and Molecular Biology*, Academic Press, Inc., 1992.

Accordingly the types of enzymes which may appropriately be incorporated in particles of the invention include oxidoreductases (EC 1.-.-.-), transferases (EC 2.-.-.-), hydrolases (EC 3.-.-.-), lyases (EC 4.-.-.-), isomerases (EC 5.-.-.-) and ligases (EC 6.-.-.-).

Preferred oxidoreductases in the context of the invention are peroxidases (EC 1.11.1) and laccases (EC 1.10.3.2)

Preferred hydrolases in the context of the invention are: carboxylic ester hydrolases (EC 3.1.1.-) such as lipases (EC 3.1.1.3); phytases (EC 3.1.3.-), e.g. 3-phytases (EC 3.1.3.8) and 6-phytases (EC 3.1.3.26); glycosidases (EC 3.2, which fall within a group denoted herein as "carbohydrases"), such as α-amylases (EC 3.2.1.1).

In the present context, the term "carbohydrase" is used to denote not only enzymes capable of breaking down carbohydrate chains (e.g. starches or cellulose) of especially five- and six-membered ring structures (i.e. glycosidases, EC 3.2), but also enzymes capable of isomerizing carbohydrates, e.g. six-membered ring structures such as D-glucose to five-membered ring structures such as D-fructose.

Carbohydrases of relevance include the following (EC numbers in parentheses):

α-amylases (EC 3.2.1.1), β-amylases (EC 3.2.1.2), glucan 1,4-α-glucosidases (EC 3.2.1.3), endo-1,4-beta-glucanase (cellulases, EC 3.2.1.4), endo-1,3(4)-β-glucanases (EC 3.2.1.6), endo-1,4-β-xylanases (EC 3.2.1.8), dextranases (EC 3.2.1.11), chitinases (EC 3.2.1.14), polygalacturonases (EC 3.2.1.15), lysozymes (EC 3.2.1.17), β-glucosidases (EC 3.2.1.21), α-galactosidases (EC 3.2.1.22), amylo-1,6-glucosidases (EC 3.2.1.33), xylan 1,4-β-xylosidases (EC 3.2.1.37), glucan endo-1,3-β-D-glucosidases (EC 3.2.1.39), α-dextrin endo-1,6-α-glucosidases (EC3.2.1.41), glucan endo-1,3-α-glucosidases (EC 3.2.1.59), glucan 1,4-β-glucosidases (EC 3.2.1.74), glucan endo-1,6-β-glucosidases (EC 3.2.1.75), arabinan endo-1,5-α-L-arabinosidases (EC 3.2.1.99), chitosanases (EC 3.2.1.132).

Examples of commercially available lipases include Lipoprime™ Lipolase™, Lipolase™ Ultra, Lipozyme™, Palatase™, Novozym™ 435 and Lecitase™ (all available from Novozymes A/S).

Other commercially available lipases include Lumafast™ (*Pseudomonas mendocina* lipase from Genencor International Inc.); Lipomax™ (*Ps. pseudoalcaligenes* lipase from Gist-Brocades/Genencor Int. Inc.; and *Bacillus* sp. lipase from Solvay enzymes. Further lipases are available from other suppliers.

Examples of commercially available carbohydrases include Alpha-Gal™, Bio-Feed™ Alpha, Bio-Feed™ Beta, Bio-Feed™ Plus, Bio-Feed™ Plus, Novozyme™ 188, Celluclast™, Cellusoft™, Ceremyl™, Citrozym™, Denimax™, Dezyme™, Dextrozyme™, Finizym™, Fungamyl™, Gamanase™, Glucanex™, Lactozym™, Maltogenase™, Pentopan™, Pectinex™, Promozyme™, Pulpzyme™, Novamyl™, Termamyl™, AMG™ (Amyloglucosidase Novo), Maltogenase™ and Aquazym™ (all available from Novozymes A/S). Further carbohydrases are available from other suppliers.

Enzyme Substrate

The enzyme substrate used in the present invention is a material which can be modified, degraded and/or altered by the enzyme used in the present invention. In a particular embodiment of the present invention, the enzyme and the substrate are present in the particle in such amounts, that the substrate changes in structure to an extent that makes the particle lose its integrity and thereby releases the rinse benefit agent into the rinse liquor. The substrate is preferably water insoluble.

Enzyme-Substrate Pair

The term "enzyme-substrate pair" is used in relation to the enzyme and the substrate comprised in the particle and where the "substrate" is a substrate for the enzyme, meaning that the enzyme will recognize the substrate and will react with it.

The enzyme is used to alter the substrate in order to release the rinse benefit agent into the process. This means that if an enzyme is chosen, the group of substrates from which to select is given and vice versa.

If a lipase is chosen, examples of lipase substrates, which are not necessarily naturally occurring, include but are not limited to lipids, mono-, di- and triglycerides such as tripalmitin, palm oil, beeswax, jojoba wax, polyesters, ester wax, Polycaprolactone (PCL) and mixtures thereof.

If a cutinase is chosen, examples of cutinase degradable materials, which are not necessarily naturally occurring, include but are not limited to triglycerides, waxes, polyesters and mixtures thereof. In a particular embodiment of the present invention the enzyme is a cutinase and the enzyme substrate is selected from the group consisting of tripalmitin, palm oil, beeswax, jojoba wax, polyester ester wax, Polycaprolactone (PCL) and mixtures thereof.

If cellulase is chosen, examples of cellulase substrates include but are not limited to the group consisting of cellulose, methyl cellulose, ethyl cellulose, propyl cellulose, carboxymethyl cellulose, cellulose monoacetate, cellulose diacetate, cellulose triacetate, Rayon, cuprammonium rayon, crystalline cellulose, amorphous cellulose, beta 1,3-1-4 glucan and mixtures thereof.

If a polysaccharide lyase or polysaccharide hydrolase is chosen, a polysaccharide-comprising material is given as enzyme substrate. Examples of polysaccharide-comprising materials include but are not limited to gellan gum, xanthan gum, schizophillan gum, scleroglucan gum, alginate, carageenan gum and pectin such as protopectin or pectic acid.

In a particular embodiment of the present invention the enzyme is pectate lyase and the enzyme substrate is selected from the group consisting of pectin of various modifications.

If a xylanase is chosen a xylan-comprising material is given. Examples of xylan-comprising enzyme substrates include but are not limited to xylan and carboxymethyl xylan.

In a particular embodiment of the present invention the enzyme is a xylanase and the enzyme substrate is selected from the group consisting of to birch xylan, wheat xylan, oat husk xylan, corn cob xylan.

If an amylase is chosen, a starch-comprising enzyme substrate is given. Starch is a mixture of amylose and amylopectin. The ratio of these two components may vary. Naturally occurring forms occur in the 20:80 to 30:70 range. Amylases, for the purpose of the invention, can mean any enzyme capable of modifying intermolecular bonds present in amylose or amylopectin.

Blends of enzyme substrates mentioned in the above section are possible and may give unique barrier properties. Furthermore the barrier properties of such blends can be partially or totally destroyed through use of an enzyme acting on a component of the blend.

Further non limiting examples of enzyme substrate-enzyme pairs are:

Polyhydroxyalkanoate (PHAs) such as polyhydroxybutyrate (PHB), poly-4-hydroxybutyrate (P4HB), polyhydroxyvalerate (PHV), polyhydroxyhexanoate (PHH), polyhydroxyoctanoate (PHO) and their copolymers. These compounds were first identified in bacteria such as *Alcaligenes eutrophus*. PHAs. Enzymes that can modify PHAs have been identified such as Polyhydroxybutyrate depolymerase (EC 3.1.1.75).

Enzymes relevant for modifying starch and starch based biopolymers are in a non limiting example: amylases, glucoamylase ((EC 3.2.1.3) and EC 3.2.1.20), amylase (EC 3.2.1.1); pullulanase (EC 3.2.1.41); maltogenic amylase (EC 3.2.1.133); neopullulanase (EC 3.2.1.135); maltotetraose-forming a-amylase (EC 3.2.1.60); isoamylase (EC 3.2.1.68); glucodextranase (EC 3.2.1.70); maltohexaose-forming a-amylase (EC 3.2.1.98); maltopentaose-forming a-amylase (EC 3.2.1.-).

Suitable substrates for amylases include thermoplastic starch which is raw starch to which a flexibiliser and plasticiser such as sorbitol or glycine are added. The amounts of added plasticiser affect the properties of thermoplastic starch.

Blending starch with degradable synthetic aliphatic polyesters such as PLA and PCL has recently become a focus of biodegradable plastic development. Biodegradable plastics can be prepared by blending up to 45% starch with degradable PCL. This new material is amenable to coating payload particles because the melting temperature is typically only 60° C. and it gets soft at temperatures above 40° C. The following are non limiting examples of such blends: Mater-Bi™ (produced by Novamont, Italy) and Bioflex™ (produced by Biotech Germany).

Other polyesters that are blended with starch to improve material mechanical properties are polybutylene succinate (PBS) or polybutylene succinate adipate (PBSA). A small amount (5% by weight) of compatibiliser (maleic anhydride functionalised polyester) can be added to impart phase stability to these starch based polymer blends. At higher starch content (>60%), such sheets can become brittle. For this reason, plasticisers are often added to reduce the brittleness and improve flexibility. Starch content, and addition of plasticisers can be used to alter the physical properties or melting temperature.

Enzymes capable of modifying chitin are for example Chitinase (EC 3.2.1.14). Chitin is a polysaccharide that is synthesized from units of N-acetylglucosamine. These units form covalent β-1,4 linkages (similar to the linkages between glucose units forming cellulose). The acetylamine group allows for increased hydrogen bonding between adjacent polymers, giving the chitin-polymer matrix increased strength. Chitin layers do exhibit barrier properties that can be modulated by the degree of acetylation or other modifications. Other known modifications include but are not limited too: phosphated chitin (P-chitin), phosphated-sulfated chitin (PS-chitin), and sulfated chitin (S-chitin).

Aside from hydrolysis of the chitin barrier, chitin can also be deacetylated by the action of enzymes such as chitin deacetylase (EC-3.5.1.41). Full deacetylation leads to a conversion from chitin to chitosan. Chitosan can be gel like, water and fat absorbing and certainly not as mechanically strong as chitin. Therefore, one method of the invention is use of chitin as a barrier substance and a chitin deacetylase as the enzyme pair. Full or even partial deacetylation of the chitin in the formulated particle will allow for release of the payload. Furthermore, chitosan has bioadhesive effects thus conversion of all or some of the chitin in the barrier may also affect binding of the particles to components in the chosen application.

Bioplastics; polyester resins may be used such as Impranil® DLN Dispersion W 50 which is an anionic aliphatic polyester-polyurethane dispersion produced by Bayer (Bayer MaterialScience AG,D-51368 Leverkusen, Germany www.bayercoatings.com). The aqueous suspension can be applied to particles where the polyester can form a barrier. Bionolle is a biodegradable resin produced by Showa Highpolymer Co., Ltd, Japan. Ecoflex® is BASF's completely biodegradable and compostable plastic. BAK1095 is a thermoplastic polyester amide from Bayer.

Polyester Wax is a synthetic wax (Nature, 1957, 179 1345). It has a low melting point of 37° C.

The wax is soluble in most organic solvents, including alcohols, ethers, esters, ketones and hydrocarbons; warming to 25° C. facilitates solution.

Ester wax 1960 is a synthetic wax (Quarterly Journal of Microscopical Science, Vol 101, 459-462, 1960). This wax is typical of ester wax blends and consists of:

| | |
|---|---|
| Diethylene glycol disterate | 60 g |
| Glycerol monosterate | 30 g |
| 300 polyethylene glycol disterate | 10 g |

Ester wax 1960 has a melting point of 48° C. Adjustments in the melting temperature are achieved by adjusting relative component concentrations.

Polycaprolactone (PCL) is a biodegradable polyester with a low melting point of around 60° C. and a glass transition temperature of about −60° C. PCL can be prepared by ring opening polymerization of ε-caprolactone using a catalyst such as stannous octanoate. As mentioned in the previous section, PCL can be blended with starch to form thermoplastic starches. Amylose degrading enzymes can be used to degrade such blends. In addition, PCL itself is degradable with serine esterases. In the following non limiting examples lipases (EC 3.1.1.3), and cutinases ((EC 3.1.1.74) have been demonstrated to be able to degrade PCL plastics (U.S. Pat. No. 6,255,451 B1). Furthermore, commercial products such as Impranil, Bionolle and Ecoflex are also degradable by serine esterases. Ester and polyester waxes are also degradable by the same enzymes.

In addition to the above waxes and plastics, the following natural products can also be degraded with serine esterases such as lipase and cutinase; rosin gum, bees wax, jojoba wax. Essentially any natural fat or oil can be used in the invention as a barrier and these can be degraded by serine esterases such as lipase or cutinase.

Auxiliary Particle Components

The particle may further comprise known conventional materials used in formulation of active components as auxiliary particle components such as binders, solvents, fillers etc., e.g. as described in WO 89/08694, WO 89/08695, EP 270608 B1 and/or WO 00/01793. Other examples of conventional coating materials may be found in U.S. Pat. No. 4,106,991, EP 170360, EP 304332, EP 304331, EP 458849, EP 458845, WO 97/39116, WO 92/12645A, WO 87/07292, WO 91/06638, WO 92/13030, WO 93/07260, WO 93/07263, WO 96/38527, WO 96/16151, WO 97/23606, U.S. Pat. Nos. 5,324,649, 4,689,297, EP 206417, EP 193829, DE 434-4215, DE 4322229 A, DD 263790, JP 61162185 A and/or JP 58179492.

Fillers

Suitable fillers are water soluble and/or inorganic salts such as finely ground alkali sulphate, alkali carbonate and/or alkali chloride), clays such as kaolin (e.g. Speswhite™, English China Clay), bentonites, talcs, zeolites such as zelolite 4A or zeolite A24, chalk, calcium carbonate, silicates and/or silicas.

Binders

Suitable binders are binders with a high melting point or no melting point at all and of a non waxy nature e.g. polyvinyl pyrrolidone, polyvinylalcohol, high melting point ethoxylated alcohols, high melting point polyethyleneglycols or polyethylene oxides, cellulose derivatives, for example hydroxypropyl cellulose, hydroxypropyl methyl cellulose, methyl cellulose or carboxy methyl cellulose, carbohydrate binders like starch, dextrin, maltodextrin, pregelatinized starch, sugars and polyols, for example sucrose, mannitol, lactose and sorbitol, gums like gum arabic, pectin or alginate, protein-type binders like gelatin or any other binder known in the art. A suitable binder is a carbohydrate binder such as Glucidex 21D available from Roquette Freres, France or Avedex W80 from Avebe, Netherlands.

Preparation of the Particle

The invention further provides a process for preparing the particle of the invention.

The particles may be prepared by methods known to those skilled in the art of granulation, including mixer granulation, fluid bed coating, prilling, disc granulation, pan drum coating, spray drying, extrusion, fluid bed spray drying, high shear agglomeration, spheronization or combinations of these techniques.

Particles of relevance may be but are not limited to layered products, absorbed products, pelletized products, and prilled products. The particles may optionally be dried after granulation. The particles may further be sieved after granulation.

Methods for preparing the particle can be found in Handbook of Powder Technology; Particle size enlargement by C. E. Capes; Volume 1; 1980; Elsevier. Preparation methods include known granulation technologies, i.e.:

a) Spray dried products, wherein a liquid rinse benefit agent-containing solution is atomized in a spray drying tower to form small droplets which during their way down the drying tower dry to form a rinse benefit agent-containing particulate material. Very small particles can be produced this way (Michael S. Showell (editor); *Powdered detergents*; Surfactant Science Series; 1998; vol. 71; page 140-142; Marcel Dekker).

b) Layered products, wherein the rinse benefit agent is coated as a layer around a pre-formed inert core particle, wherein an rinse benefit agent-containing solution is atomized, typically in a fluid bed apparatus wherein the preformed core particles are fluidized, and the active component-containing solution adheres to the core particles and dries up to leave a layer of dry active component on the surface of the core particle. Particles of a desired size can be obtained this way if a useful core particle of the desired size can be found. This type of product is described in e.g. WO 97/23606.

c) Absorbed core particles, wherein rather than coating the rinse benefit agent as a layer around a core, the rinse benefit agent is absorbed onto and/or into the surface of the core. Such a process is described in WO 97/39116.

d) Extrusion or pelletized products, wherein an rinse benefit agent-containing paste is pressed to pellets or under pressure is extruded through a small opening and cut into particles which are subsequently dried. Such particles usually have a considerable size because of the material in which the extrusion opening is made (usually a plate with bore holes) sets a limit on the allowable pressure drop over the extrusion opening. (Michael S. Showell (editor); *Powdered detergents*; Surfactant Science Series; 1998; vol. 71; page 140-142; Marcel Dekker).

e) Prilled products, wherein an rinse benefit agent in form of a powder is suspended in molten wax and the suspension is sprayed, e.g. through a rotating disk atomiser, into a cooling chamber where the droplets quickly solidify (Michael S. Showell (editor); *Powdered detergents*; Surfactant Science Series; 1998; vol. 71; page 140-142; Marcel Dekker). The product obtained is one wherein the rinse benefit agent is uniformly distributed throughout an inert material instead of being concentrated on its surface. Also U.S. Pat. Nos. 4,016,040 and 4,713,245 are documents relating to this technique.

f) Mixer granulation products, wherein a rinse benefit agent-containing liquid is added to a dry powder composition of conventional granulating components. The liquid and the powder in a suitable proportion are mixed and as the moisture of the liquid is absorbed in the dry powder, the components of the dry powder will start to adhere and agglomerate and particles will build up, forming granulates comprising the rinse benefit agent. Such a process is described in U.S. Pat. No. 4,106,991 (NOVO NORDISK) and related documents EP 170360 B1 (NOVO NORDISK), EP 304332 B1 (NOVO NORDISK), EP 304331 (NOVO NORDISK), WO 90/09440 (NOVO NORDISK) and WO 90/09428 (NOVO NORDISK).

g) Size reduction, wherein the cores are produced by milling or crushing of larger particles, pellets, tablets, briquettes etc. containing the rinse benefit agent. The wanted core particle fraction is obtained by sieving the milled or crushed product. Over and undersized particles can be recycled. Size reduction is described in (Martin Rhodes (editor); Principles of Powder Technology; 1990; Chapter 10; John Wiley & Sons).

h) Fluid bed granulation. Fluid bed granulation involves suspending particulates in an air stream and spraying a liquid onto the fluidized particles via nozzles. Particles hit by spray droplets get wetted and become tacky. The tacky particles collide with other particles and adhere to them and form a granule.

i) The cores and particles may be subjected to drying, such as in a fluid bed drier. Other known methods for drying granules in the feed or enzyme industry can be used by the skilled person. The drying preferably takes place at a product temperature of from 25 to 90° C. After drying, the cores preferably contain 0.1-10% w/w water.

Layers may be applied onto the particle comprising the active component by atomization onto the particles in a fluid bed or a fluid bed spray dryer, the layers may further be applied in mixers, drageé type coaters (pan-drum coaters), equipment for coating of seeds, equipment comprising rotating bottoms (eks. Roto Glatt, CF granulators (Freund), torbed processors (Gauda) or in rotating fluid bed processors such as Omnitex (Nara).

After applying the barrier layer the particle may optionally be dried. The drying of the particle can be achieved by any drying method available to the skilled person, such as spray-drying, freeze drying, vacuum drying, fluid bed drying, pan drum coating and microwave drying. Drying of the particle can also be combined with granulation methods which comprise e.g. the use of a fluid bed, a fluid bed spray dryer (FSD) or a Multi-stage dryer (MSD).

Conventional coatings and methods as known to the art may suitably be used, such as the coatings described in Danish PA 2002 00473, WO 89/08694, WO 89/08695, 270 608 B1 and/or WO 00/01793. Other examples of conventional coating materials may be found in U.S. Pat. No. 4,106,991, EP 170360, EP 304332, EP 304331, EP 458849, EP 458845, WO 97/39116, WO 92/12645A, WO 89/08695, WO 89/08694, WO 87/07292, WO 91/06638, WO 92/13030, WO 93/07260, WO 93/07263, WO 96/38527, WO 96/16151, WO 97/23606, WO 01/25412, WO 02/20746, WO 02/28369, U.S. Pat. Nos. 5,879,920, 5,324,649, 4,689,297, 6,348,442, EP 206417, EP 193829, DE 4344215, DE 4322229 A, DE 263790, JP 61162185 A and/or JP 58179492.

In a particular embodiment the substrate coating is applied via hot melt coating in a fluid bed. This method is well known in the art. The melted coating material is sprayed onto the cores in a fluidized bed. The fluidization gas has a temperature below the solidification temperature of the coating material (see e.g. "Fluid Bed Coating" by Teunou & Poncelet in "Encapsulated And Powdered Foods", edited by Onwulata, CRC Press 2005).

In a particular embodiment the process for preparing the particle of the invention comprises the steps of:

a) preparing a core comprising a benefit agent;
b) optionally applying a protective layer onto the core of a);
c) applying a layer comprising an enzyme; and
d) applying one or more barrier layer(s) comprising a material which is degradable by the enzyme of c).

Optional Further Coating

The particle may comprise further layers or coatings besides the barrier layer to provide further improved properties of the particle.

Optionally, the particles may be pre-coated by applying a protective pre-coat to cores comprising the rinse benefit agent before applying the coating according to the invention. The pre-coat may serve to protect and retain the rinse benefit agent during the further processing and may consist, e.g., of a fat or oil.

Compositions Comprising the Particle and their Application

The particles of the invention may be added to cleaning compositions, including fabric and home care detergent products, for use in treatment of textile and hard surfaces.

Detergents

The particles of the invention may be used as a component of a detergent composition. The detergent composition may for example be formulated as a laundry or dishwash detergent composition for hand or machine washings including a cleaning additive composition suitable for pre-treatment of stained fabrics or a fabric softener composition, or a detergent composition for use in general household hard surface cleaning operations, or a composition for hand or machine dishwashing operations.

The detergent composition may be in any convenient dry form, e.g., a bar, a tablet, a powder, a particle or a paste. It may also be a liquid detergent, in particular low-content aqueous (less than 70% by weight) or non-aqueous liquid detergent.

The detergent composition comprises one or more surfactants, which may be non-ionic including semi-polar and/or anionic and/or cationic and/or zwitterionic. The level of surfactants is typically from 0.1% to 60% by weight. In a dishwash detergent, it is typically from 0.1 to 15%, particularly 2-12%.

When included therein the detergent will usually contain from about 1% to about 40% of an anionic surfactant such as linear alkylbenzenesulfonate, alpha-olefinsulfonate, alkyl sulfate (fatty alcohol sulfate), alcohol ethoxysulfate, secondary alkanesulfonate, alpha-sulfo fatty acid methyl ester, alkyl- or alkenylsuccinic acid or soap.

When included therein the detergent will usually contain from about 0.2% to about 40% of a non-ionic surfactant such as alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides"). In a dishwash detergent, the level of nonionic surfactants is typically from 2 to 12%.

The detergent may contain 0-65% of a detergent builder or complexing agent such as zeolite, diphosphate, triphosphate, phosphonate, carbonate, citrate, nitrilotriacetic acid, ethylenediaminetetraacetic acid, diethylenetriaminepentaacetic acid, alkyl- or alkenylsuccinic acid, soluble silicates or layered silicates (e.g. SKS-6 from Hoechst). In a dishwash detergent, the level of builder is typically 40-65%, particularly 50-65%.

The detergent composition may comprise one or more other enzymes such as a protease, a lipase, a cutinase, an amylase, a carbohydrase, a cellulase, a pectinase, a mannanase, an arabinase, a galactanase, a xylanase, an oxidase, e.g., a laccase, and/or a peroxidase The detergent may comprise one or more polymers. Examples are carboxymethylcellulose, poly(vinylpyrrolidone), poly(ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid copolymers.

The detergent may contain a bleaching system, which may comprise a $H_2O_2$ source such as perborate or percarbonate, which may be combined with a peracid-forming bleach activator such as tetraacetylethylenediamine or nonanoyloxybenzenesulfonate. Alternatively, the bleaching system may comprise peroxyacids of e.g. the amide, imide, or sulfone type. A dishwash detergent typically contains 10-30% of bleaching system.

The detergent may also contain other conventional detergent ingredients such as e.g. fabric conditioners including clays, foam boosters, suds suppressors, anti-corrosion agents, soil-suspending agents, anti-soil redeposition agents, dyes, bactericides, optical brighteners, hydrotropes, tarnish inhibitors, or perfumes.

Washing Process

The term "rinse cycle" means the cycle after the main wash cycle in a laundry washing or dish washing process wherein the wash load is treated with rinse water to remove the detergent for the wash load.

For detergents such as laundry or dishwashing detergents it is intended that the particles release the rinse benefit agent(s) into one or more of the rinse cycles subsequent to the main wash cycle in order to maximise the effectiveness of the rinse benefit agent. It is envisaged that the current invention may be employed in a wide range of wash processes and hence it may be necessary to adjust the composition and/or morphology of particle to optimise its release characteristics.

Typical wash processes would include the use of front loading automatic machines which may include a lengthy high temperature wash cycle with high levels of mechanical agitation followed by two, three or four short rinse cycles. Top loading automatic or semi automatic machines may be used which would involve the use of a shorter, low temperature main wash cycle followed by only one or two rinse cycles. It is also anticipated that the current invention will be utilized in hand wash processes, where the wash cycle is at ambient temperature and is of varying length and involving variable levels of mechanical agitation. In this hand-wash process, the number of rinse cycles may vary from one to seven.

In a preferred embodiment, the triggered-release particles are incorporated in the main detergent composition and are hence dosed into the wash process in a manner that is typically associated with the specific wash process and will be well known to those skilled in the art.

In another embodiment, the triggered-release particles are incorporated in an ancillary detergent component that is contained in a dosing device that keeps it separate from the main detergent composition until both are in contact with the liquor of the main wash cycle and aids retention of the intact particles within the wash vessel from one cycle to the next.

EXAMPLES

Example 1

This example describes a screening assay to assess the activity profile (enzymatic activity under wash versus rinse conditions in a laundry process, respectively) of combinations or pairs of enzymes and substrates. The aim of this assay is to select pairs of enzymes and substrates which display the desired activity profile, namely low enzymatic activity during wash conditions relative to the enzymatic activity during rinse.

For demonstration (Table 1 below), we provide the activity index (score parameter) from comparison of a series of data. For a given pair of enzyme and substrate, enzymatic activity was quantified under wash and rinse conditions, respectively. The activity index results from the difference in net activity during rinse and wash, multiplied by the sum of the activities during wash and rinse. Table 1 below lists the activity index calculated for a series of preferred hydrophobic substrates and two esterases, a cutinase and a lipase. Note that the polyester systems display a negative activity index, indicating that these combinations of enzymes and potential substrates are hydrolyzed faster under wash conditions than under rinse conditions. Particularly high activity indices were recorded for glycerides in combination with a lipase, specifically mono-, di- and tripalmitin.

The specific experiments were carried out in a beaker format at room temperature; alternatively this type of assay could take form as a HTS assay in microtiter plates. The potential substrates were suspended with the non-ionic surfactant TX-100 in a buffer solution adjusted to pH 9. We evaluated enzymatic activity in this assay by monitoring the change in pH due to hydrolysis using a standard pH-meter. Alternative methods include but are not limited to light scattering, calorimetry, ultrasound velocimetry, and spectrophotometry.

TABLE 1

| | Avocado butter | Bees wax | Carnauba wax | Candelilla wax | Castor oil | Palm oil | Polyester |
|---|---|---|---|---|---|---|---|
| Cutinase | −0.01 | 0.06 | 0 | 0.01 | 0 | 0 | −2.45 |
| Lipase | 0.53 | 0.04 | 0.01 | 0.05 | 0.43 | 0.04 | −1.64 |

| | Polycaprolactone | Monopalmitin | Dipalmitin | Tripalmitin |
|---|---|---|---|---|
| Cutinase | 0.02 | 0.30 | 2.32 | 1.20 |
| Lipase | 0.01 | 7.55 | 3.52 | 4.80 |

Example 2

A sample of 4 kg of $Na_2SO_4$ cores (350-500 μm) was transferred to a GEA MP 3/2/3 conventional fluid bed apparatus. Using a bottom spray/Wurster coating technique with an air inlet temperature of ca. 65° C., air outlet temperature of ca. 43° C. and with air quantity of 250 kg per hour the following steps were carried out in sequence:

a) an enzyme containing layer was applied onto the $Na_2SO_4$ cores by spraying a Savinase® (protease) aqueous solution (concentrate) at a rate of 30 g per minute. Approximately 250 g Savinase® concentrate were applied per kg cores. After adding the concentrate the water was allowed to evaporate from the coated cores (until the temperature rose quickly in the fluid bed).

b) an additional enzyme layer of 0.02 g lipase (Lipex®) per kg core was applied by spraying an aqueous lipase solution (0.6 g Lipex® concentrate in 1 kg of water) onto the product of a), at a spraying rate of 35 g per minute.

c) a final coating was applied by spraying 200 g of melted (heated to ca. 100° C.) tripalmitin per kg product, at a spraying rate of 30 g per minute.

The finished enzyme containing granule was subsequently cooled to room temperature for 20 minutes.

Example 3

An enzyme containing granule was produced as in Example 2, with the exception that no lipase coating was applied to the product.

Example 4

An enzyme containing granule was produced as in Example 2, with the exception that no lipase coating was applied and PEG 4000 was used as final coating instead of tripalmitin.

Example 5

An enzyme containing granule was produced as in example 2, with the exception that palm oil was used instead of tripalmitin as substrate and spray dried lipase was mixed into the palm oil before the coating comprising the substrate and the lipase was applied to the core particle.

Example 6

The release profile of the granules produced as in Example 2, 3 and 4 during wash and rinse conditions was studied by use of the following assay:

a) 0.6 g of liquid detergent (comprising 30% water, 20% Neodol 25-7EO [ex Shell Chemicals], 14% alkyl benzene sulphonic acid, 9% mono propylene glycol, 7% sodium lauryl tri-ethoxy sulphate, 5% glycerol, 5% Prifac 5908 [ex Uniqema], 3% triethanolamine, 3% sodium hydroxide, 1% citric acid) was added to 100 ml of water (dH° 12) in a beaker glass.

b) 20 mg of granules was transferred to a tea bag (with a mesh size of 160 μm, allowing flow through) which was subsequently placed in the beaker glass of a).

c) Stirring was applied to the beaker glass and a 2 ml sample was taken every 5 minutes. The samples were immediately placed in a freezer after they were taken.

d) After 40 minutes in wash conditions the tea bag with granules was transferred to a new beaker glass with 100 ml of tap water. The stirring was applied and a 2 ml sample was taken every 5 minutes.

e) After 10 minutes in rinse conditions the tea bag with granules was transferred to a new beaker glass with 100 ml of tap water. The stirring was applied and a 2 ml sample was taken every 5 minutes. The rinse conditions were repeated totally 4 times.

f) All the samples taken from the wash and rinse solutions were analyzed for enzyme (Savinase®) activity.

The results are given in table 2, wherein the enzyme activities of the samples are given in percentage of full Savinase® release of the respective granules.

TABLE 2

| | Release during wash | Release during rinse |
|---|---|---|
| granule (Ex. 1) | 20% | 80% |
| granule (Ex. 2) | 2% | 8% |
| granule (Ex. 3) | 100% | — |
| granule (Ex. 5) | 20% | 80% |

It is clear from the results that where a substrate and an enzyme are present in the granule, a desired release profile is obtained. The results show that it is possible to prepare a granule where constituents to be used in the rinse cycle during wash will be released as they should during rinse.

Example 7

Perfume-containing granule cores were produced batchwise by adding 1.86 kg of zeolite A24 to a Roto Junior mixer (ex Zanchetta). The impellor and chopper were switched-on and 250 g of a perfume (comprising 11.3% 1-acetate, 2-(1,1-dimethylethyl)-cyclohexanol, 1.6% 1-(2,6,6-trimethyl-3-cyclohexen-1-yl)-2-buten-1-one, 6.6% dodecanal, 6.7% 4-(2,6,6-trimethyl-1-cyclohexen-1-yl)-3-buten-2-one, 6.7% 4,7-Methano-1H-inden-6-ol, 3a,4,5,6,7,7a-hexahydro-, 6-acetate, 6.7% 2-ethyl-4-(2,2,3-trimethyl-3-cyclopenten-1-yl)-2-buten-1-ol, 6.7% 1-(1,2,3,4,5,6,7,8-octahydro-2,3,8,8-tetramethyl-2-naphthalenyl)-ethanone, 6.7% 2-(phenylmethylene)-octanal, 6.7% Oxacyclohexadecan-2-one, 6.7% Benzeneacetic acid, 2-phenylethyl ester, 6.7% 2-methyl-pentanoic acid, ethyl ester, 6.7% octanal, 6.7%

3,7-dimethyl-3-octanol, 6.7% benzyl ethanoate, 6.7% 3,7-dimethyl-, 3-acetate-1,6-octadien-3-ol) was slowly added. When fully mixed, molten lauryl ethoxylate (80 EO) at 70° C. was slowly added to the mixer until approximately the correct granularity (as judged by eye) was obtained. This require approximately 250 g of the alcohol ethoxylate. The contents of the mixer were then sieved to retain the fraction with a granule diameter between 355 and 710 microns. The lower diameter fraction was returned to the mixture and the above procedure repeated until sufficient quantity was produced.

Example 8

A sample of 3 kg of perfume-containing granule cores produced as an Example 7 was transferred to a GEA MP 3/2/3 conventional fluid bed apparatus. Using a bottom spray/Wurster coating technique with an air inlet temperature of ca. 65° C., air outlet temperature of ca. 43° C. and with air quantity of 250 kg per hour the following steps were carried out in sequence:

a) an enzyme containing layer was applied onto the agglomerated Zeolite cores (350-700 μm) by spraying a Lipex® aqueous solution (0.6 g Lipex® concentrate in 1 kg of water) at a rate of 35 g per minute. Approximately 0.02 g Lipex® were applied per kg cores. After adding the concentrate the water was allowed to evaporate from the coated cores (until the temperature rose quickly in the fluid bed).

b) a final coating was applied by spraying 200 g of melted (heated to ca. 100° C.) tripalmitin per kg product, at a spraying rate of 30 g per minute.

The finished enzyme containing granule was subsequently cooled to RT for 20 minutes.

Example 9

Core Granulation

A sample of 10 kg of Zeolite powder was transferred to a conventional Lödiger mixer. The shovel speed was approximately 180 rpm, the knife speed was 3000 rpm and the mixer temperature was around 40° C. By slowly adding approximately 2.5 kg of melted (75° C.) PEG4000 to the Zeolite powder granulated particles was generated. The granules were sieved between 300 and 800 micron.

Perfume Dosing

A sample of 5 kg of sieved Zeolite/PEG4000 granules was transferred to a Lödiger mixer. The shovel speed was approximately 180 rpm and the mixer temperature was kept at room temperature. 1 kg of AKK perfume was absorbed into the granules by slowly adding the perfume.

Pre-Coat in the Mixer

A sample of 3 kg of Zeolite/PEG4000 granules with absorbed perfume was transferred to a Lödiger mixer. The shovel speed was approximately 180 rpm and the mixer temperature was kept at room temperature. A pre-coat was applied by slowly adding 0.3 kg of melted (75° C.) palm oil (Palmotex 16T, Aarhus Oliefabrik A/S, Aarhus, Denmark) to the granules.

Final Coating in a Fluid Bed

Four different samples were prepared by applying coatings as follows.

Final Coat 1 (Reference):

A sample of 0.75 kg of pre-coated granules was transferred to a STREA conventional fluid bed. Using a top spray coating technique with an air inlet temperature of ca. 30° C., air outlet temperature of ca. 40° C. and with air quantity of 70 kg per hour the final coating were applied by spraying 0.25 kg of melted (80° C.) tripalmitin, at a spray rate of 25 g per minutes.

Final Coat 2 (Invention):

A sample of 0.75 kg of pre-coated granules was transferred to a STREA conventional fluid bed. Using a top spray coating technique with an air inlet temperature of ca. 30° C., air outlet temperature of ca. 40° C. and with air quantity of 70 kg per hour the final coating were applied by spraying 0.25 kg of melted (80° C.) tripalmitin mixed with 0.3 g spray dried lipase (*Thermomyces lanuginosus* lipase with a total activity of 591 KLU), at a spray rate of 25 g per minutes (1 KLU=1000 LU, unit defined in WO 00/32758).

Final Coat 3 (Invention):

A sample of 0.75 kg of pre-coated granules was transferred to a STREA conventional fluid bed. Using a top spray coating technique with an air inlet temperature of ca. 30° C., air outlet temperature of ca. 40° C. and with air quantity of 70 kg per hour the final coating were carried out in the following sequence: first an aqueous lipase solution (1.1 g *Thermomyces lanuginosus* lipase concentrate (Lipolase™, *Thermomyces lanuginosus* lipase with a total activity of 2200 KLU) in 0.1 kg of water) is sprayed onto the product at a spraying rate of 15 g per minutes, then followed by spraying 0.25 kg of melted (80° C.) tripalmitin, at a spray rate of 25 g per minutes.

Final Coat 4 (Reference):

A sample of 0.75 kg of pre-coated granules was transferred to a STREA conventional fluid bed. Using a top spray coating technique with an air inlet temperature of ca. 30° C., air outlet temperature of ca. 40° C. and with air quantity of 70 kg per hour the final coating were applied by spraying 0.25 kg of melted (80° C.) PEG4000, at a spray rate of 25 g per minutes.

Example 10

190 g of sieved Zeolite/PEG4000 granules prepared as in Example 9 were dosed with 10 g of AKK perfume, pre-coated with 20 g of Palmotex 16T, followed by coating with 50 g of tripalmitin. In one sample, 0.07 g of spray-dried lipase was added to the tripalmitin, and in another sample 0.07 g of spray-dried lipase was added to the Palmotex.

Two further samples were prepared in the same manner, excerpt that PEG4000 was used instead of Palmotex.

Example 11

An enzyme containing granule is produced as in example 2, with the exception that a pectate lyase is used instead of a lipase, and 5% (W/W) poly-galacturonic acid as substrate is mixed with tripalmitin before the coating is applied to the core particle.

Example 12

An enzyme containing granule is produced as in example 2, with the exception that a cellulase is used instead of a lipase, and 5% (W/W) barley beta-glucan as substrate is mixed with tripalmitin before the coating is applied to the core particle.

Example 13

An enzyme containing granule is produced as in example 2, with the exception that an amylase is used instead of a lipase, and 5% (W/W) potato starch as substrate is mixed with tripalmitin before the coating is applied to the core particle.

The invention claimed is:

1. A particle for triggered release of a rinse benefit agent, said particle comprising:

a) a first enzyme, b) a rinse benefit agent selected from the group consisting of perfumes, encapsulated perfumes, masking agents, chemical malodor neutralizers, physical malodor neutralizers, pro-fragrances, fiber lubricants, anti-static agents, anti-wrinkle agents, antifoam, photo-protective agents, optical brighteners, soil release polymers, soil repelling agents, stain repellent agents, fabric softening compounds, anti-microbial agents, insecticides, fungicides, insect repellents, moisture management agents, shading dyes, dye fixing agents, a second enzyme and mixtures thereof, and c) a water-insoluble substrate for said first enzyme, wherein the rinse benefit agent and the first enzyme are surrounded by a barrier layer comprising a water-insoluble continuous layer comprising the substrate, and wherein the mean particle size is in the range of 0.1 to 2000 μm.

2. The particle of claim 1, wherein the first enzyme which acts on the substrate is selected from the group consisting of amylases, lipases, cellulases, cutinases and mixtures thereof.

3. The particle of claim 1, wherein the water-insoluble substrate is selected from the group consisting of monoglycerides, diglycerides, triglycerides, wax esters and mixtures thereof.

4. The particle of claim 1, wherein the particle comprises a core containing the rinse benefit agent and a layer comprising the substrate surrounding the core.

5. The particle of claim 4, wherein the core further comprises a carrier particle.

6. The particle of claim 1, wherein the rinse benefit agent, the substrate and the first enzyme are present together.

7. The particle of claim 1, wherein the particle comprises a first layer comprising the rinse benefit agent and a second layer comprising the substrate.

8. A process for preparing a particle of claim 1, comprising the steps of:

a) preparing a core comprising the benefit agent, b) applying one or more layers, wherein a layer comprises the first enzyme or the substrate for said first enzyme or both.

9. The process of claim 8, where the particle is prepared in a mixer, a fluid bed, a fluid bed spray dryer, a spray dryer or an extruder.

10. A dishwash detergent composition comprising the particles of claim 1.

11. A process for washing kitchenware, comprising a washing step wherein soiled kitchenware is contacted with an aqueous composition comprising the dishwash detergent composition of claim 10, followed by a rinsing step wherein the rinse benefit agent is released from the particles into the rinse liquid.

12. The particle of claim 1 wherein the rinse agent is a perfume.

13. The particle of claim 1 wherein the rinse agent is a masking agent.

14. The particle of claim 1 wherein the rinse agent is a chemical malodor neutralizer.

15. The particle of claim 1 wherein the rinse agent is a physical malodor neutralizer.

16. The particle of claim 1 wherein the rinse agent is a pro-fragrance.

17. The particle of claim 1 wherein the rinse agent is a lubricant.

18. The particle of claim 1 wherein the rinse agent is an optical brightener.

19. The particle of claim 1 wherein the rinse agent is a fabric softener.

20. The particle of claim 1, wherein the mean particle size is in the range of 50 to 1400 μm.

21. The particle of claim 1, the mean particle size is in the range of 100 to 1000 μm.

* * * * *